US011803138B2

(12) United States Patent
Horie et al.

(10) Patent No.: US 11,803,138 B2
(45) Date of Patent: Oct. 31, 2023

(54) FIXING APPARATUS WITH BLOWER MEMBER FOR MULTI-DIRECTIONAL COOLING

(71) Applicant: HEWLETT-PACKARD DEVELOPMENT COMPANY, L.P., Spring, TX (US)

(72) Inventors: Takayuki Horie, Yokohama (JP); Yasuo Suzuki, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/925,688

(22) PCT Filed: Jan. 29, 2021

(86) PCT No.: PCT/US2021/015646
§ 371 (c)(1),
(2) Date: Nov. 16, 2022

(87) PCT Pub. No.: WO2021/236179
PCT Pub. Date: Nov. 25, 2021

(65) Prior Publication Data

US 2023/0205116 A1 Jun. 29, 2023

(30) Foreign Application Priority Data

May 18, 2020 (JP) ..... 2020-086393

(51) Int. Cl.
*G03G 21/20* (2006.01)
*G03G 15/20* (2006.01)

(52) U.S. Cl.
CPC ..... *G03G 15/2021* (2013.01); *G03G 21/206* (2013.01)

(58) Field of Classification Search
CPC ... G03G 15/2021; G03G 21/20; G03G 21/206
USPC ..... 399/92, 122, 320, 328, 329, 341
See application file for complete search history.

(56) References Cited

U.S. PATENT DOCUMENTS

| | | | | |
|---|---|---|---|---|
| 9,268,269 | B2 * | 2/2016 | Sekiya | G03G 21/206 |
| 10,126,708 | B2 | 11/2018 | Oya | |
| 10,241,447 | B2 * | 3/2019 | Kishi | G03G 21/206 |
| 10,732,568 | B2 * | 8/2020 | Hasegawa | G03G 21/206 |
| 2004/0091294 | A1 | 5/2004 | Tani et al. | |
| 2005/0214669 | A1 | 9/2005 | Hayashi et al. | |
| 2010/0034569 | A1 | 2/2010 | Moteki | |
| 2010/0209148 | A1 | 8/2010 | Hiramoto et al. | |
| 2012/0121286 | A1 | 5/2012 | Suzuki | |
| 2016/0124384 | A1 | 5/2016 | Mizutani | |

(Continued)

FOREIGN PATENT DOCUMENTS

| | | | |
|---|---|---|---|
| CN | 1873560 | * | 12/2006 |
| JP | 2013-041212 | A | 2/2013 |

(Continued)

*Primary Examiner* — Hoan H Tran
(74) *Attorney, Agent, or Firm* — Foley & Lardner LLP

(57) ABSTRACT

A fixing apparatus can include a heater roller, a tension roller, a belt movable from the heater roller to the tension roller, a pressure roller to make pressure contact with the heater roller via the belt to form a fixing nip, and a blower member including a first opening to direct air toward the belt and a second opening to direct air toward the heater roller.

15 Claims, 14 Drawing Sheets

(56) References Cited

U.S. PATENT DOCUMENTS

| | | | |
|---|---|---|---|
| 2016/0274537 | A1 | 9/2016 | Yamashita et al. |
| 2018/0253045 | A1 | 9/2018 | Yukimoto et al. |
| 2018/0341218 | A1 | 11/2018 | Adaniya et al. |

FOREIGN PATENT DOCUMENTS

| | | | |
|---|---|---|---|
| JP | 2014-006408 | A | 1/2014 |
| JP | 2016-090671 | A | 5/2016 |
| JP | 2016-173490 | A | 9/2016 |
| JP | 2018-197840 | A | 12/2018 |
| WO | 2018/225874 | A1 | 12/2018 |

* cited by examiner

FIXING APPARATUS WITH BLOWER MEMBER FOR MULTI-DIRECTIONAL COOLING

CROSS REFERENCE TO RELATED APPLICATIONS

This application is a U.S. National Stage Application which claims the benefit under 35 U.S.C. § 371 of International Patent Application No. PCT/US2021/015646 filed on Jan. 29, 2021, which claims priority benefit from Japanese Patent Application No. 2020-086393 filed on May 18, 2020, the contents of each of which are incorporated herein by reference.

BACKGROUND

An image forming apparatus such as a copier, a printer, a facsimile or a multifunctional machine using an electrophotographic system heats and pressurizes a printing medium on which a toner image is carried and thereby fixes the toner image onto the printing medium, and outputs the printing medium on which the toner image is formed (i.e., a print output). In recent years, with the widespread use of digital cameras and the like, demand for photographic or gloss-imparted print outputs has been increasing. Accordingly, image forming apparatuses may be provided with a fixing apparatus having the function of forming gloss.

DETAILED DESCRIPTION

Figure 1:
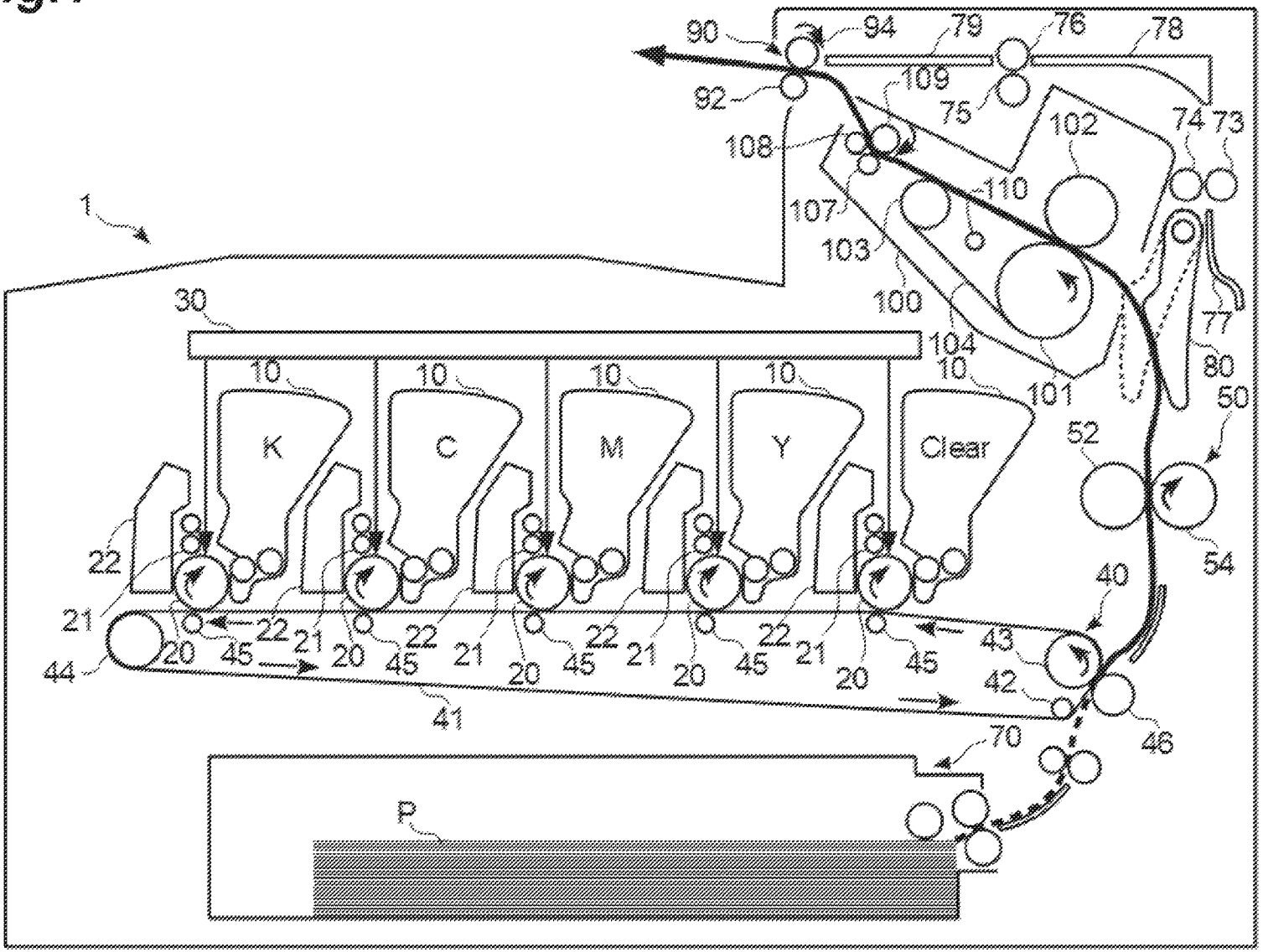
FIG. 1 is a schematic diagram of an image forming apparatus according to one example of the present disclosure.

An imaging forming apparatus may carry out a gloss imparting technology, such as a cooling stripping technology, by which a printing medium having a toner image formed thereon, is heated and pressed in order to fuse the toner image, and by which the printing medium is subsequently cooled while in surface contact with an endless belt, and thereafter stripped off from the endless belt. By allowing the printing medium to contact the endless belt while the printing medium is being cooled, the fused toner image reproduces a mirror-finished surface of the endless belt and solidifies, so as to form gloss on the toner image.

Hereinafter, various examples of the present disclosure are described with reference to the drawings. The same or similar reference numerals in different drawings denote the same or similar components, and overlapping description is omitted.

With reference to FIG. 1, an example image forming apparatus 1 includes five developing devices 10, five photosensitive drums 20, five charging rollers 21 and five cleaning units 22, respectively, for four color toners, including yellow, magenta, cyan and black (YMCK) toners, and a clear toner. In the present description, developing device 10 may refer to one or more of the developing devices 10, the photosensitive drums 20 may refer to one or more of the photosensitive drums 20, the charging rollers 21 may refer to one or more of the charging rollers 21 and the cleaning units 22 may refer to one or more of the cleaning units 22. Each developing device 10 can store therein a toner of the corresponding color. The image forming apparatus 1 can include an exposure unit 30, a transfer device 40, a first fixing apparatus 50, a second fixing apparatus 100 having the function of imparting gloss, a printing medium conveyance unit 70, a conveyance path switching device 80 and a discharge device 90. The conveyance path switching device 80 includes a guide plate that is pivotable about an axis of rotation, and the guide plate may be rotated or pivoted by a driving device such as, for example, a solenoid. The transfer device 40 can include an intermediate transfer belt 41, suspension rollers 42, 43 and 44 suspending (or supporting) the intermediate transfer belt 41 in a rotatable manner, five primary transfer rollers 45 corresponding respectively to the five photosensitive drums 20, and a secondary transfer roller 46 following the rotation of the intermediate transfer belt 41 and to thereby rotate while pressing a printing medium (or print medium) P that is conveyed from the printing medium conveyance unit 70, against the intermediate transfer belt 41. The suspension roller 43 may be configured as a driving roller that drives the intermediate transfer belt 41 to rotate in the directions indicated by the arrows. The discharge device 90 can include a pair of discharge rollers 92 and 94.

The first fixing apparatus 50 can include a fixing roller 52 and a pressure roller 54. The fixing roller 52 can include therein a heater element such as a halogen lamp. In some examples, the fixing roller 52 may be a fixing belt. Either the fixing roller 52 or the pressure roller 54 or both may be rotated by a driving device. In some examples, the pressure roller 54 may be a pressure belt. The fixing roper 52 and the pressure roller 54 may be equipped with a separation/contact mechanism used for preventing adhesion of the fixing roller 52 to the pressure roller 54 when the image forming apparatus is not used.

FIG. 1 shows an example operation of the image forming apparatus 1 in a case of forming a gloss-imparted print output or a gloss image (also referred to as a "high-gloss image"). When a gloss image is to be formed, the image forming apparatus 1 forms a toner image including clear toner on the intermediate transfer belt 41 by using the five developing devices 10 including a developing device 10 corresponding to clear toner. Specifically, the image forming apparatus 1 causes the five photosensitive drums 20 to be charged by the corresponding charging rollers 21, respectively, and to form respective electrostatic latent images thereon by the exposure unit 30 according to corresponding image data. Next, the electrostatic latent images on the five photosensitive drums 20 are developed by the respective developing devices 10 to form toner images. Next, the toner images formed are transferred onto the intermediate transfer belt 41 by the primary transfer rollers 45, in a layered matter so as to combine the toner images into a single toner image on the intermediate transfer belt 41 to be transferred to the printing medium P. The printing medium P is conveyed from the printing medium conveyance unit 70 to the transfer device 40 which cooperates with the secondary transfer roller 46 to transfer the toner image including clear toner from the intermediate transfer belt 41 to the printing medium P.

In one example; when a gloss image is formed, the image forming apparatus 1 may use both the first fixing apparatus 50 and the second fixing apparatus 100. The first fixing apparatus 50 can receive the printing medium P having the toner image including clear toner from the transfer device 40, and apply heat and pressure to the toner image using the fixing roller 52 and the pressure roller 54, in order to fix (e.g., fuse and fix) the toner image onto the printing medium P. The second fixing apparatus 100 can receive the printing medium P having the toner image including clear toner, that has been conveyed from the first fixing apparatus 50. The second fixing apparatus 100 can re-fuse the toner image formed on the received printing medium P, by applying heat and pressure thereto, and to subsequently cool the printing medium P. The cooled printing medium P is sent out toward the discharge device 90 and subsequently discharged from the image forming apparatus 1 via the discharge rollers 92 and 94. The second fixing apparatus 100 will be further described below.

In another example, the image forming apparatus 1 can also form a non-gloss image (also referred to as "normal image" or "standard image"). To form a non-gloss image, the image forming apparatus 1 forms a toner image without any clear toner (e.g., a toner image free of clear toner) on the intermediate transfer belt 41 using developing devices 10 corresponding to the four color toners (YMCK). The printing medium P is conveyed from the printing medium conveyance unit 70 to the transfer device 40, and the transfer device 40 cooperates with the secondary transfer roller 46 to transfer the toner image that is free of clear toner, from the intermediate transfer belt 41 to the printing medium P.

When the aforementioned non-gloss image is formed, the conveyance path switching device 80 is moved to a "bypass position" indicated by a broken line in FIG. 1 so that the printing medium P bypasses the second fixing apparatus 100 after passing through the first fixing apparatus 50. The first fixing apparatus 50 can receive the printing medium P having the toner image that is free of clear toner from the transfer device 40, and apply heat and pressure to the toner image using the fixing roller 52 and the pressure roller 54, thereby fixing (e.g., fusing and fixing) the toner image onto the printing medium P. The printing medium P onto which the toner image that is free of clear toner, is fixed in the first fixing apparatus 50 may be subsequently conveyed along guide plates 77, 78 and 79 via respective pairs of conveyance rollers 73 and 74, and 75 and 76, to the discharge device 90, Accordingly, the printing medium P may be conveyed to the discharge device 90 bypassing (i.e., avoiding conveyance through) the second fixing apparatus 100, and discharged from the image forming apparatus 1 through the discharge rollers 92 and 94 of the discharge device 90.

In another example, the second fixing apparatus 100 can be dual-function so as to operate as a gloss-imparting device or as a standard fixing apparatus according to whether or not a gloss image is to be formed. In that case, the image forming apparatus 1 may not include the first fixing apparatus 50. In this example, when the second fixing apparatus 100 operates as a gloss-imparting device, for example, when a gloss image is to be formed, the second fixing apparatus 100 can receive the printing medium P having the toner image including clear toner from the transfer device 40. The second fixing apparatus 100 can fix (e.g., fuse and fix) the toner image including the clear toner onto the printing medium P by applying heat and pressure thereto, and cooling the toner image. The cooled printing medium P is conveyed to the discharge device 90 and to be discharged out from the image forming apparatus 1 via the discharge rollers 92 and 94. When the second fixing apparatus 100 operates as a standard fixing apparatus, for example, when a non-gloss image is to be formed, the second fixing apparatus 100 can receive the printing medium P having the toner image that is free of clear toner, from the transfer device 40. The second fixing apparatus 100 can fix (e.g., fuse and fix) the toner image without clear toner onto the printing medium P by applying heat and pressure thereto, and cooling the toner image. The cooled printing medium P is conveyed to the discharge device 90 to be discharged from the image forming apparatus 1 via the discharge rollers 92 and 94. The second fixing apparatus 100 may include a heater roller 101 to heat the toner image, and an endless belt 104 to convey the print medium. When the second fixing apparatus 100 operates as a standard fixing apparatus, a preset temperature of the heater roller 101 of the second fixing apparatus 100 is set to be higher than a preset temperature in the case of operating as a gloss-imparting device, and a moving speed (a conveyance speed of the printing medium P) of the endless belt 104 may be set to be greater than a moving speed in the case of operating as a gloss-imparting device. The heater roller 101 and the endless belt 104 will be described further below.

Figure 2:
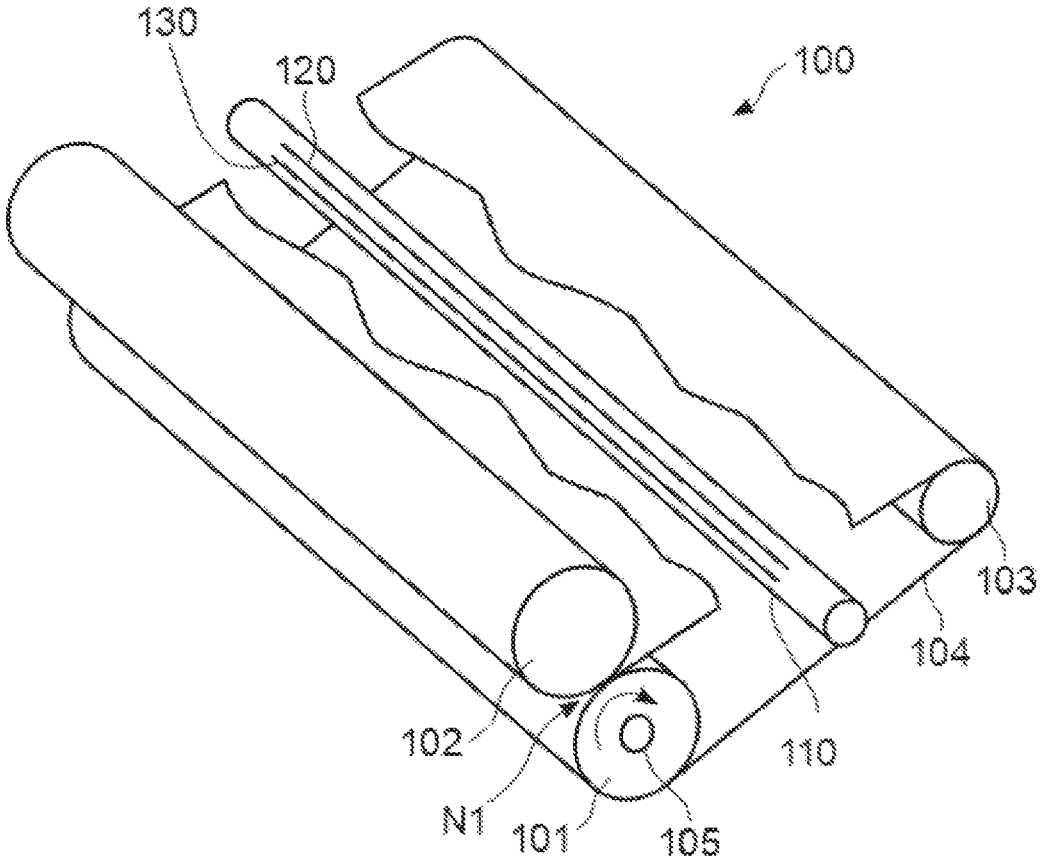
FIG. 2 is a schematic perspective view of a second fixing apparatus according to one example of the present disclosure.

FIG. 2 schematically shows the example second fixing apparatus 100, illustrated with the endless belt 104 partially cut away. The second fixing apparatus 100 can include the heater roller 101, a pressure roller 102, a tension roller 103, the endless belt 104 and a blower member 110 disposed on the inner circumferential surface side of the endless belt 104. The heater roller 101 may include a heater element 105 such as a halogen lamp disposed lengthwise therein, and may be rotated by a driving device in the rotational direction of the arrow illustrated in FIG. 2. The tension roller 103 may be disposed at a certain distance from the heater roller 101. The endless belt 104 can be tensioned between the heater roller 101 and the tension roller 103, and follow rotation of the heater roller 101, to rotate. The pressure roller 102 makes pressure contact with the heater roller 101 via the endless belt 104 to form a fixing nip N1. The pressure roller 102 can follow a rotation of the heater roller 101, to rotate while pressing the printing medium P against the heater roller 101 via the endless belt 104, in which an image surface of the printing medium P faces the heater roller 101 side. Heat and pressure is applied to the toner image on the printing medium P at the fixing nip N1 between the heater roller 101 and the pressure roller 102, and the toner image may thereby be fixed (fused and fixed or re-fused and fixed). Subsequently, the printing medium P may be conveyed from the heater roller 101 to the tension roller 103 by the endless belt 104. During conveyance, the toner image on the printing medium P may be cooled and solidified while adhering with the outer circumferential surface of the endless belt 104. Beyond the tension roller 103, the printing medium P may be stripped from the endless belt 104 due to the flexural rigidity of the printing medium P, and a curvature of the tension roller 103 and sent out toward the discharge device 90 through conveyance rollers 107, 108 and 109 shown in FIG. 1.

In order to impart gloss to a toner image, the outer circumferential surface of the endless belt 104 may be formed of a highly mold-releasable material such as fluororesin, for example, perfluoroalkoxy alkane (PFA) and the like, and processed to be a mirror surface or a smooth surface. The smooth surface may have an arithmetic average roughness Ra of, for example, 0.3 μm or less. In some examples, the arithmetic average roughness Ra may be of 0.1 μm or less.

There may be various paper sizes for the printing medium P. Therefore, the width of the endless belt of the second fixing apparatus is shaped to support the maximum width of a paper size printable in the image forming apparatus. When a printing medium P of a width narrower than that of the endless belt passes through the second fixing apparatus, at a portion where the printing medium P passes ("paper passing portion"), heat is transmitted to the printing medium P and the heater roller 101 and the pressure roller 102 are thereby deprived of heat and kept at predetermined temperatures. However, at a portion where the printing medium P does not pass ("non-paper passing portion"), no heat is deprived from the heater roller 101 and the pressure roller 102. Therefore, the temperature of the paper passing portion and that of the non-paper passing portion are different. Particularly, when the second fixing apparatus is configured to have both the usual fixing function and the gloss-imparting function, thermal conductivity of the heater roller is high to reduce the warm-up time and the electrical consumption, and a difference in temperatures between the paper passing portion and the non-paper passing portion may therefore increase. Successive printing jobs may further increase the temperature of the non-paper passing portion, thereby also damaging the second fixing apparatus. Although the printing operation may be stopped or a printing speed may be reduced until the temperature of the non-paper passing portion is decreased down to a predetermined temperature, productivity is reduced. Accordingly, in order to maintain productivity, the temperature of the heater roller at the non-paper passing portion may be prevented from rising to a temperature equal to or greater than a predetermined temperature, for example by cooling the non-paper passing portion of the heater roller. While a plurality of heaters and the like may be used to control the heating at different portions of the heating roller, this may increase the cost for the apparatus and the widths of the heaters may not suit the widths of various printing medium. In addition, in order to cool the printing medium P and solidify the toner image on the printing medium P adhering with the outer circumferential surface of the endless belt 104, as mentioned earlier, the endless belt 104 may be cooled. While separate cooler devices can be provided to cool the endless belt 104 and the heater roller, respectively, this may lead to upsizing of the apparatus, and a higher manufacturing cost for the apparatus.

The example second fixing apparatus 100 can be provided with the blower member 110 disposed on the inner circumferential surface side of the endless belt 104. Such a blower member 110 can be provided with a first opening 120 and a second opening 130 to blow airflow (e.g., air from outside the image forming apparatus 1) received from a blower toward the endless belt 104 and toward the heater roller 101, respectively. Using such a blower member 110 allows air (airflow) gathered within the blower member 110 to be blown concurrently to the inner circumferential surface of the endless belt 104 (particularly, the portion on which the printing medium P is placed) via the first opening 120, and to the non-paper passing portion of the heater roller 101 via the second opening 130, so as to simultaneously cool the endless belt 104 and the heater roller 101, and thereby increase a cooling efficiency. In addition, as a plurality of portions can be cooled simultaneously by using such a blower member 110, the manufacturing of the cooler device can be simplified and easier, and consequently, the image forming apparatus may be manufactured at a reduced cost and size.

Figure 3:
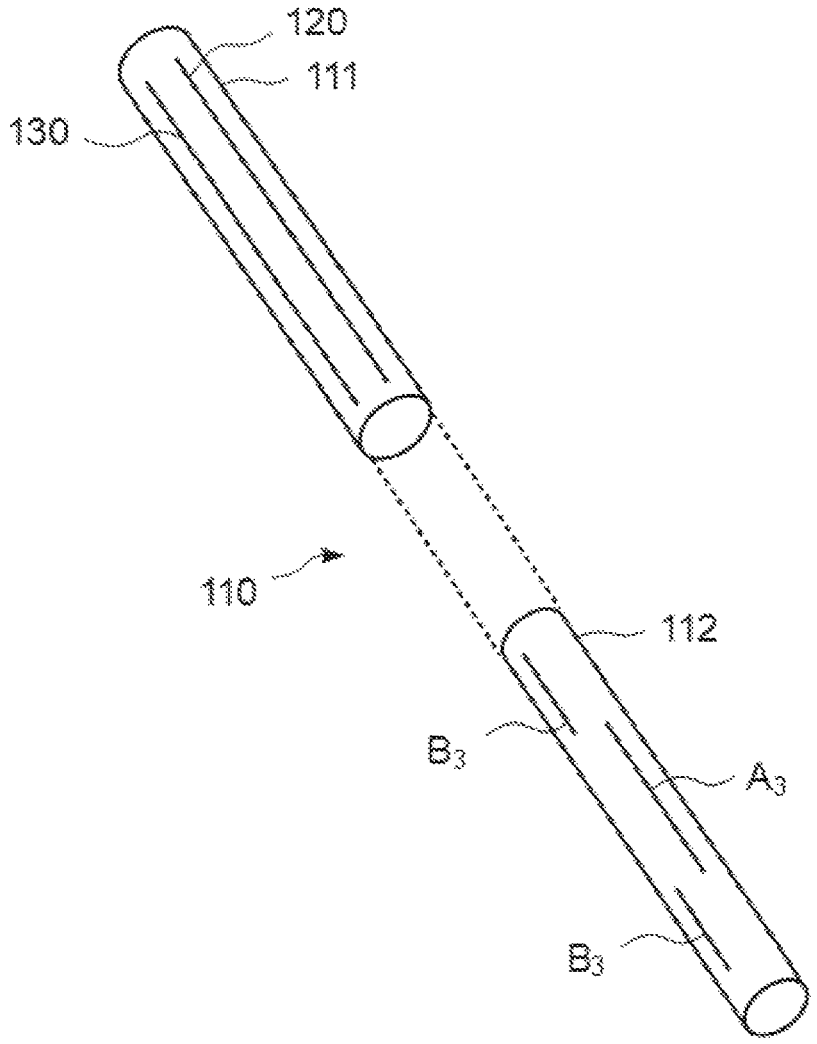
FIG. 3 is a schematic exploded view of a blower member according to one example of the present disclosure.

The blower member 110 according to one example of the present disclosure is described further in detail with reference to FIG. 3, FIGS. 4A-4C, FIGS. 5A-5B, FIGS. 6A-6B, FIGS. 7A-7B and FIGS. 8A-8B. FIG. 3 shows a schematic exploded perspective view of the blower member 110 according to one example. The blower member 110 can include a first sleeve (cylinder) 111 and a second sleeve 112 rotatably disposed inside or outside the first sleeve 111. The first sleeve 111 may be secured to a housing of the second fixing apparatus 100 and the like, for example, by a securing member. The second sleeve 112 may be configured to receive an airflow from a blower and to rotate inside or outside of the first sleeve 111 by a driving device. The first sleeve 111 and the second sleeve 112 may be formed of, for example, thermoplastic resins such as PE (polyethylene), PP (polypropylene) and ABS (acrylonitrile butadiene styrene) or a metal such as SUS (stainless steel) or aluminum. The outer diameter of the first sleeve 111 can be about 1 cm to about 10 cm. The outer diameter of the second sleeve 112 can be of a size adapted to be rotatably disposed inside or outside the first sleeve 111, In FIG. 3, distribution openings $A_3$ and $B_3$ of a pattern 3, that is described further below, are shown in the second sleeve 112 as one example.

Figure 4A:
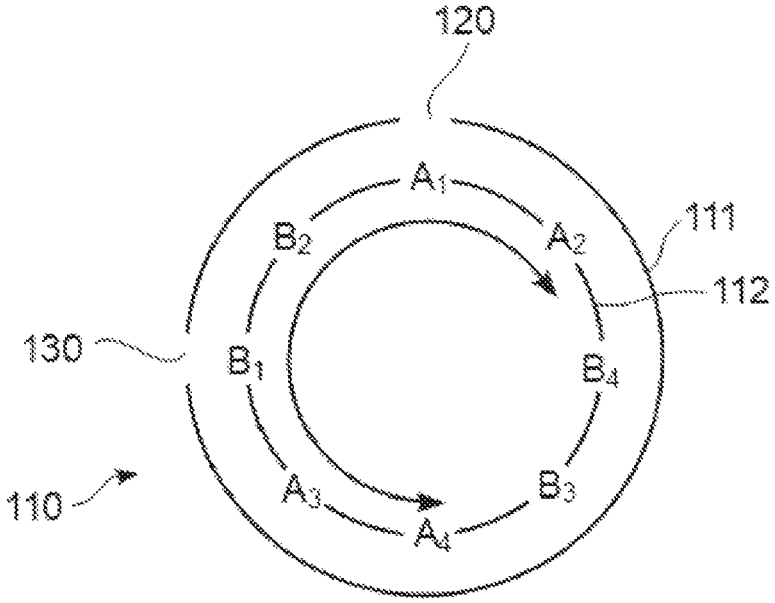
FIG. 4A is a schematic cross-sectional view of the blower member composed of first and second sleeves according to one example of the present disclosure.

In an example, the first sleeve 111 can be provided with the first opening 120 and the second opening 130 extending axially. The first opening 120 and the second opening 130 can be the same in length. For example, their lengths can be about 10 cm to 35 cm. In one example, each of the lengths of the first opening 120 and the second opening 130 can be a length substantially the same as the width of the endless belt 104. For example, as shown in FIG. 2, each of the first opening 120 and the second opening 130 can be an elongated openings extending substantially in the width direction of the endless belt 104 and having a (axial) length the same as the width of the endless belt 104. In addition, the respective widths (circumferential lengths) of the first opening 120 and the second opening 130 can be substantially the same, and their widths can be within a range of about 0.5 mm to about 5 mm, for example a width of about 2 mm. The first opening 120 can be an opening to blow airflow toward the inner circumferential surface of the endless belt 104 moving from the heater roller 101 to the tension roller 103. The second opening 130 can be an opening to blow airflow toward the heater roller 101. For example, as shown in FIG. 4A, the first opening 120 and the second opening 130 may be formed through the wall of the first sleeve 111, and may be spaced apart from each other to form an angle of 90° about an axis (e.g., a central axis of the first sleeve 111) in a cross section of the first sleeve 111. According to other examples, the angle formed can be an angle other than 90° within a range of about 40° to 120°, for example.

The second sleeve 112 includes an arrangement of openings working as a distribution mechanism to change a pattern of airflow blown from each of the first opening 120 and the second opening 130 of the first sleeve 111. The pattern of airflow may be changed according to a paper width. In one example, the pattern of airflow blown from each of the first opening 120 and the second opening 130 of the first sleeve 111 includes four patterns (patterns 1 to 4) as shown in Table 1.

TABLE 1

| | First opening 120 | Second opening 130 |
|---|---|---|
| Pattern 1 | Fully open ($A_1$) | Fully closed ($B_1$) |
| Pattern 2 | Area of opening of 80% ($A_2$) | Area of opening of 20% ($B_2$) |
| Pattern 3 | Area of opening of 60% ($A_3$) | Area of opening of 40% ($B_3$) |
| Pattern 4 | Fully closed ($A_4$) | Fully open ($B_4$) |

In the pattern 1, airflow is blown from the full length of the first opening 120, and at the same time, the second opening 130 is blocked, That is, the first opening 120 becomes fully open (an area of opening of 100%) ($A_1$ of FIGS. 4A and 4B) while the second opening 130 becomes fully closed (an area of opening of 0%) ($B_1$ of FIGS. 4A and 43). In the pattern 2, airflow is blown from a center portion of the first opening 120 and ends of the second opening. That is, the center portion is open in the first opening 120 ($A_2$ of FIGS. 4A and 4B) while the ends of the second opening 130 excluding the center portion are open (32 of FIGS. 4A and 4B), In this case, an area of opening of the first opening 120 is, for example, 80% and an area of opening of the second opening 130 is, for example, 20%. In the pattern 3, as with the aforementioned pattern 2, airflow is blown from a center portion of the first opening 120 and ends of the second opening. However, an area of opening of the first opening 120 is, for example, 60% ($A_3$ of FIGS. 4A and 4B) and an area of opening of the second opening 130 is, for example, 40% ($B_3$ of FIGS. 4A and 4B). In the pattern 4, airflow is blown from the full length of the second opening 130, and at the same time, the first opening 120 is blocked. That is, the first opening 120 becomes fully closed (an area of opening of 0%) ($A_4$ of FIGS. 4A and 4B) while the second opening 130 becomes fully open (an area of opening of 100%) ($B_4$ of FIGS. 4A and 4B).

Figure 4B:
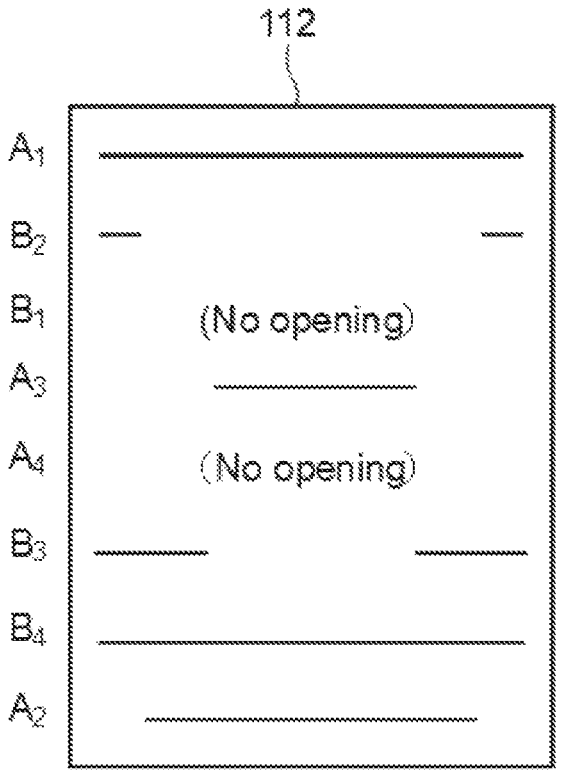
FIG. 4B is a planar-development view of the second sleeve illustrated in FIG. 4A, showing an example distribution mechanism formed in the second sleeve.

The distribution mechanism of the second sleeve 112 creating the aforementioned airflow patterns 1 to 4 is described with reference to FIGS. 4A and 4B, In this example, the second sleeve 112 is disposed inside the first sleeve 111. While the present description is explained with reference to an example in which the number of patterns is four, the number of patterns may be a number less than four or a number more than four. FIG. 4A is a view schematically showing a cross section of the blower member 110 including the first sleeve 111 and the second sleeve 112 according to one example and shows the blower member 110 being set to the pattern 1. FIG. 4B shows a planar development view of the second sleeve 112 shown in FIG. 4A and shows the distribution mechanism that the second sleeve 112 is provided with.

In FIGS. 4A and 4B, the second sleeve 112 has an axially-formed (or longitudinally extending) distribution opening and/or forms a closed portion, at positions corresponding to the first opening 120 and the second opening 130. The distribution opening may be formed through the wall of the second sleeve 112. The term "closed portion" is used for referring to a state in which the second sleeve 112 has no opening or the like extending through the wall, such that an opening in the first sleeve 111 is covered or blocked by the wall of the second sleeve 112. The second sleeve 112 is rotated and stopped by a driving device to align one of the arrangements associated with the airflow patterns, including the distribution opening $A_1$ and the closed portion $B_1$, the distribution opening $A_2$ and the distribution opening 32, the distribution opening $A_3$ and the distribution opening 33, and the closed portion $A_4$ and the distribution opening 34, to be with the first opening 120 and the second opening 130. The second sleeve 112 can rotate clockwise and counterclockwise. For example, when the distribution opening $A_1$ and the closed portion $B_1$ are aligned respectively with the first opening 120 and the second opening 130, the airflow pattern is the pattern 1. When the distribution opening $A_2$ and the distribution opening $B_2$ are aligned respectively with the first opening 120 and the second opening 130, the airflow pattern is the pattern 2. When the distribution opening $A_3$ and the distribution opening 33 are aligned respectively with the first opening 120 and the second opening 130, the airflow pattern is the pattern 3. When the closed portion $A_4$ and the distribution opening $B_4$ are aligned respectively with the first opening 120 and the second opening 130, the airflow pattern is the pattern 4.

As shown in FIG. 4B, in one example, the distribution opening $A_1$, the distribution opening 32, the closed portion $B_1$, the distribution opening $A_3$, the closed portion $A_4$, the distribution opening Ba, the distribution opening $B_4$ and the distribution opening $A_2$ are disposed in the second sleeve 112 in this order from the upper side of the drawing. In a cross section of the second sleeve 112, the distribution opening $A_1$ and the closed portion $B_1$ are disposed apart by a circumferential distance corresponding to a center angle that corresponds to an angle by which the first opening 120 and the second opening 130 are distanced from each other (e.g., 90°). Similarly, the distribution opening $A_2$ and the distribution opening 82, the distribution opening $A_3$ and the distribution opening 33 and the closed portion $A_4$ and the distribution opening $B_4$ are also disposed apart by a circumferential distance corresponding to a center angle that corresponds to an angle by which the first opening 120 and the second opening 130 are distanced from each other (e.g., 90°). A rotation of the second sleeve 112 allows a pair from the distribution opening $A_1$ and the closed portion $B_1$, the distribution opening $A_2$ and the distribution opening $B_2$, the distribution opening $A_3$ and the distribution opening 33, and the closed portion $A_4$ and the distribution opening $B_4$ of the second sleeve 112 to be selected. The distribution opening $A_1$ may be a (lengthwise) opening of a length substantially the same as that of the first opening 120. The distribution opening $A_2$ may be an opening having a length shorter than that of the first opening 120 and extending along a center portion. The distribution opening $A_3$ may be an opening having a length shorter than that of the distribution opening $A_2$, The distribution opening $B_2$ may be openings provided at ends excluding the center portion. The distribution opening $B_3$ may be openings each having a length longer than that of each opening of the distribution opening $B_2$. The distribution opening 84 may be an (lengthwise) opening of a length substantially the same as that of the second opening 130. The width (circumferential dimension) of such a distribution opening may be substantially the same as that of the first opening 120 or the second opening 130, or may be larger than that of the first opening 120 or the second opening 130 in some cases. In one example, the sum of areas of opening of the distribution openings $A_2$ and $B_2$ or $A_3$ and $B_3$ is equal to an area of opening of the distribution opening $A_1$ or $B_4$. Therefore, in any of the patterns 1 to 4, the sum of an opening rate of the first opening 120 and an opening rate of the second opening 130 is 100% and the wind speed of the airflow blown from the first opening 120 and the second opening 130 is kept substantially constant.

Figure 5A:
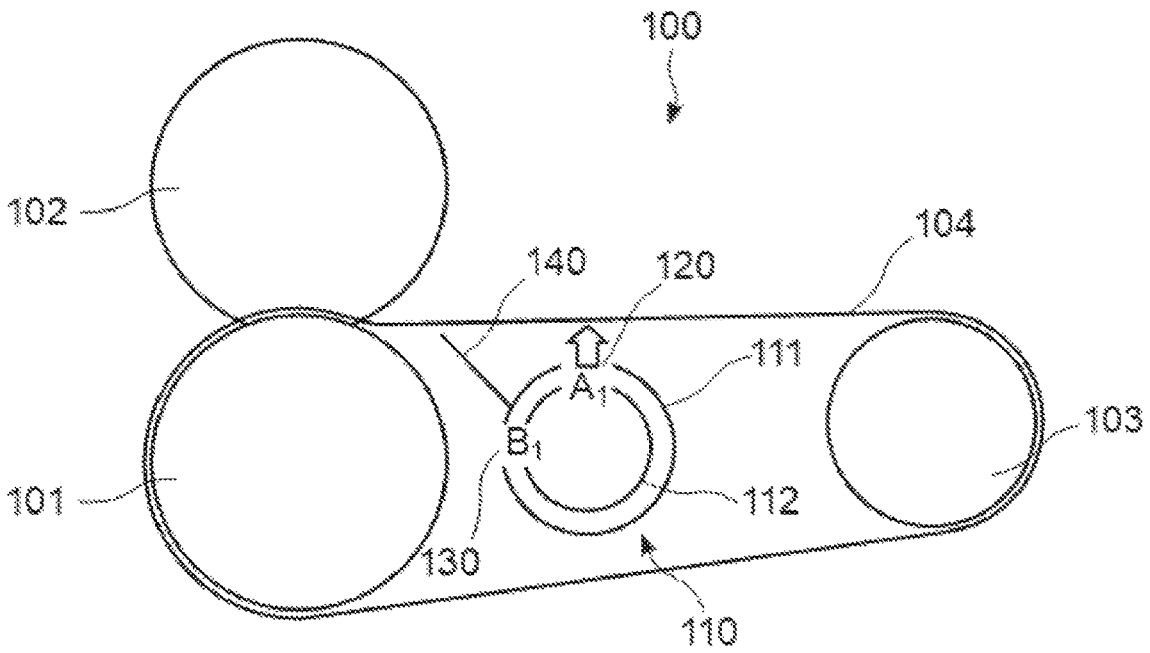
FIG. 5A is a schematic cross-sectional view of the second fixing apparatus, illustrating the blower member in an example position corresponding to a pattern 1.

The patterns 1 to 4 are further described with reference to FIGS. 5A to 5B, FIGS. 6A to 6B, FIGS. 7A to 78 and FIGS. 8A to 8B. FIGS. 5A, SA, 7A and 8A show schematic cross-sectional views of the second fixing apparatus 100 set to the patterns 1 to 4, respectively. FIGS. 5B, 6B, 7B and 8B show respective schematic perspective views of the blower member 110 shown in FIGS. 5A to 8A, respectively. In this example, the second sleeve 112 is disposed inside the first sleeve 111. In FIGS. 5B, 6B, 7B and 8B, the blank white arrows schematically show how airflow is blown out. The patterns 1 to 3 may be selected according to a paper size of the printing medium P to be printed in the image forming apparatus 1, to simultaneously cool the endless belt and the heater roller according to the paper size of the printing medium P.

Figure 5B:
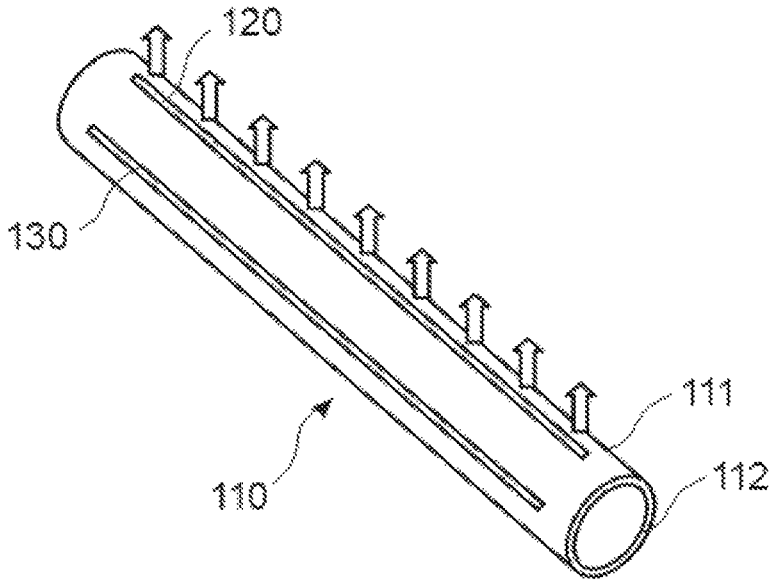
FIG. 5B is a schematic perspective view of the blower member of the second fixing apparatus illustrated in FIG. 5A.

In FIGS. 5A and 5B, the blower member 110 is set to the pattern 1. The pattern 1 may be used when the width of the printing medium P fed to the second fixing apparatus 100 is substantially the same as the width of the endless belt 104. In this case, a portion on which the printing medium P passes ("paper passing portion") is substantially the same as the length of the heater roller 101, and the heater roller 101 therefore does not need to be cooled. Accordingly, the blower member 110 blows airflow to the full width of the endless belt 104 using the first opening 120 so as to selectively cool the endless belt 104.

Figure 6A:
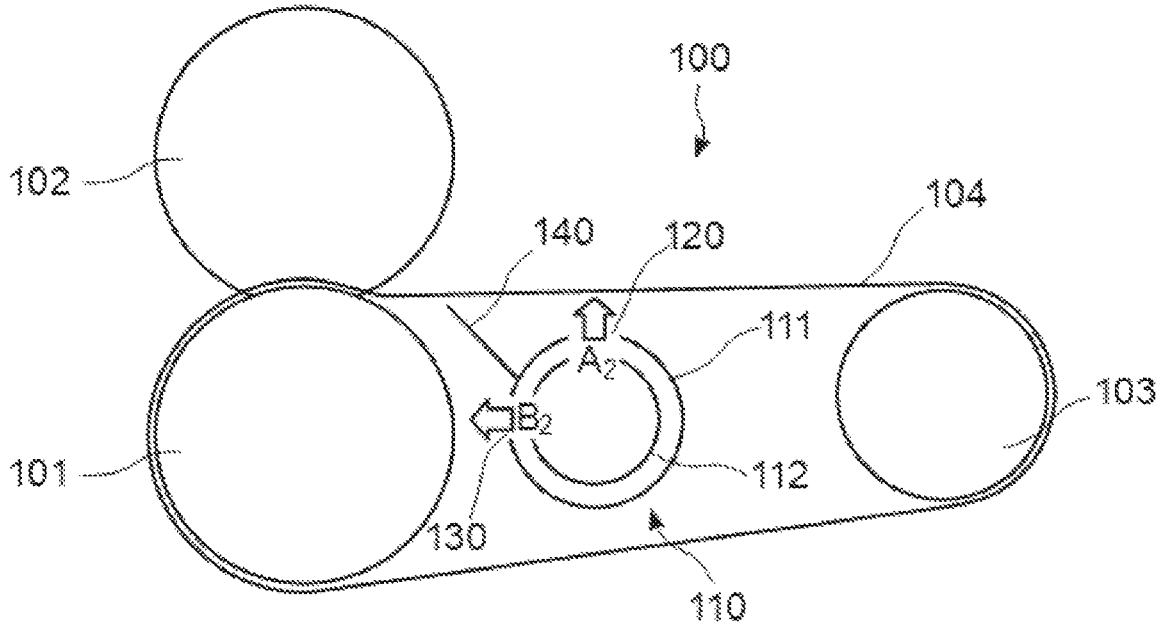
FIG. 6A is a schematic cross-sectional view of the second fixing apparatus, illustrating the blower member in an example position corresponding to a pattern 2.
Figure 6B:
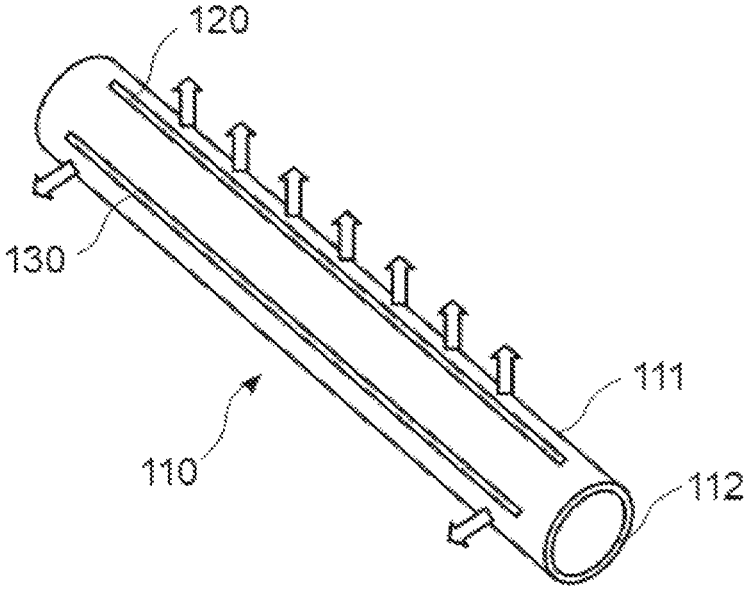
FIG. 6B is a schematic perspective view of the blower member of the second fixing apparatus illustrated in FIG. 6A.

In FIGS. 6A and 68, the blower member 110 is set to the pattern 2. The pattern 2 may be used when the width of the printing medium P fed to the second fixing apparatus 100 is less than the width of the endless belt 104. In this case, the ends (or opposite edges) of the endless belt 104 on which the printing medium P is not placed do not need to be cooled. On the other hand, a portion of the heater roller 101 on which the printing medium P passes ("paper passing portion") is shorter than the length of the heater roller 101. Thus, the ends of the heater roller 101 on which the printing medium P does not pass ("non-paper passing portions") are not deprived of heat by the printing medium P, and therefore should be cooled to prevent the temperature from increasing. The blower member 110 can blow airflow from the first opening 120 to the endless belt 104 to selectively cool a portion of the endless belt 104 on which the printing medium P is present (a center portion) and blow airflow for the ends (or edges) of the endless belt 104 which do not need to be cooled from the second opening 130 to the ends of the heater roller 101 ("non-paper passing portions").

Figure 7A:
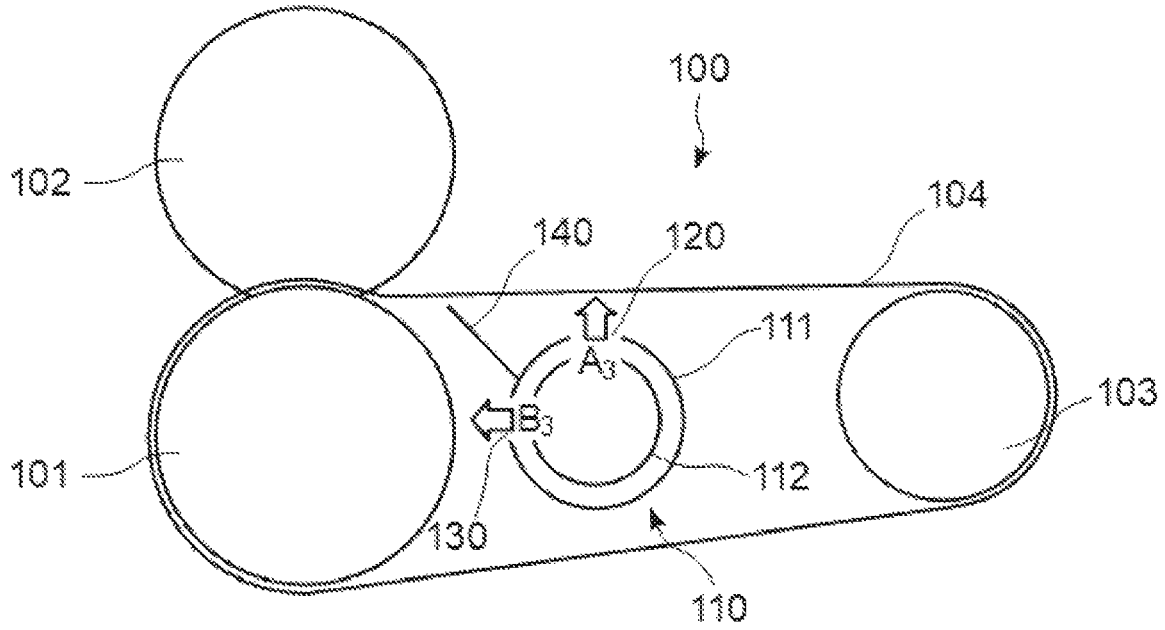
FIG. 7A is a schematic cross-sectional view of the second fixing apparatus, illustrating the blower member in an example position corresponding to a pattern 3.
Figure 7B:
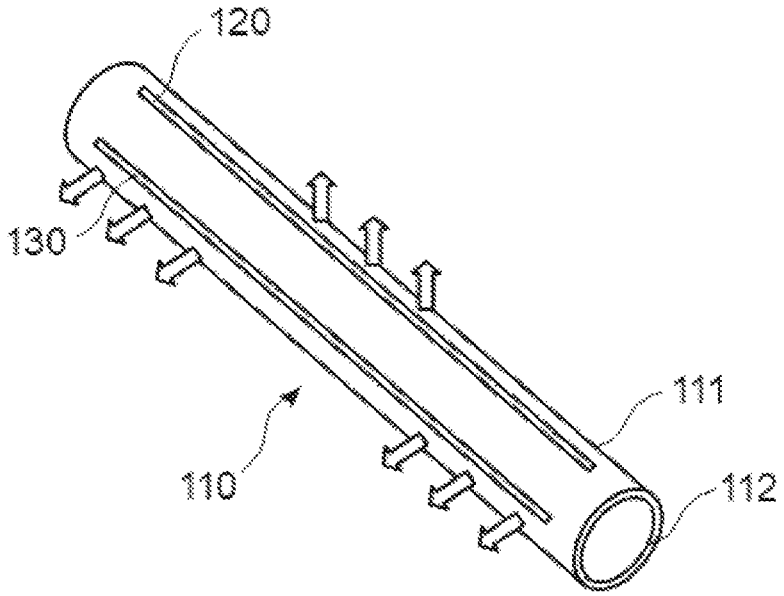
FIG. 7B is a schematic perspective view of the blower member of the second fixing apparatus illustrated in FIG. 7A.

In FIGS. 7A and 7B, the blower member 110 is set to the pattern 3 similar to the pattern 2. The pattern 3 corresponds to a printing medium P having a width less than that of the printing medium P corresponding to the pattern 2. As with the aforementioned pattern 2, also in the pattern 3, the blower member 110 can blow airflow from the first opening 120 to the endless belt 104 to selectively cool the portion of the endless belt 104 on which the printing medium P is present (a center portion) and blow airflow for the ends (or edges) of the endless belt 104 which do not need to be cooled from the second opening 130 to the ends of the heater roller 101 ("non-paper passing portions"). In this manner, the blower member 110 can be more reliably cool fused toner on the printing medium P by blowing airflow to the portion of the endless belt 104 on which the printing medium P is placed, and if the width of the printing medium P is less than that of the endless belt 104, in order to prevent the temperature of the ends of the heater roller 101 from increasing, it can utilize airflow for the ends (or edges) of the endless belt 104 which do not need to be cooled.

Figure 8A:
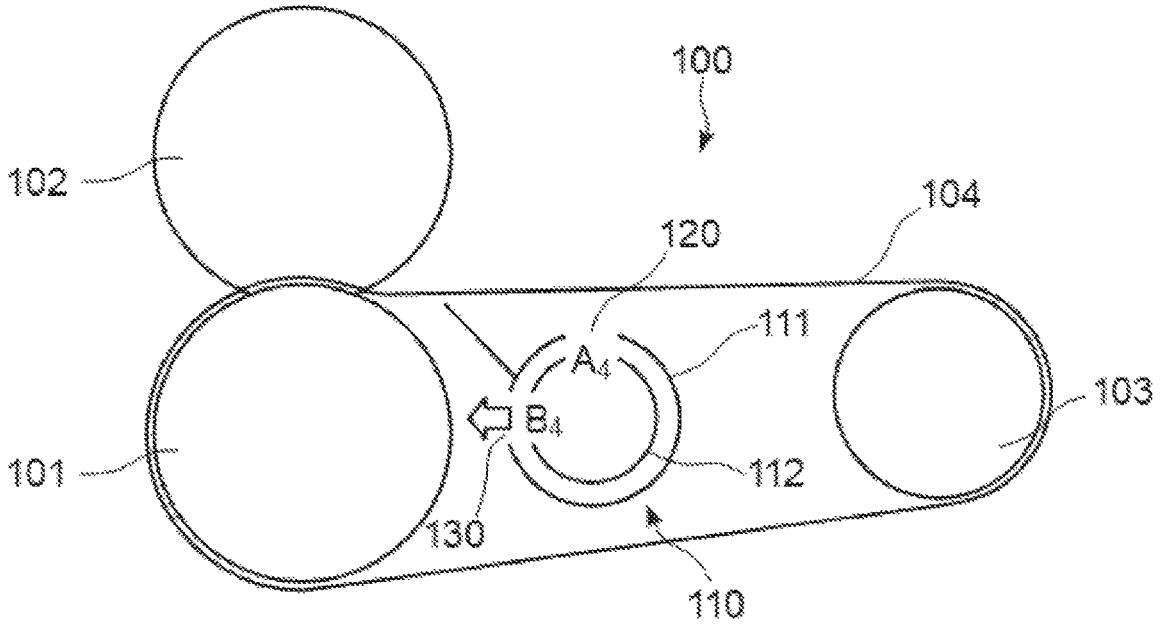
FIG. 8A is a schematic cross-sectional view of the second fixing apparatus, illustrating the blower member in an example position corresponding to a pattern 4.
Figure 8B:
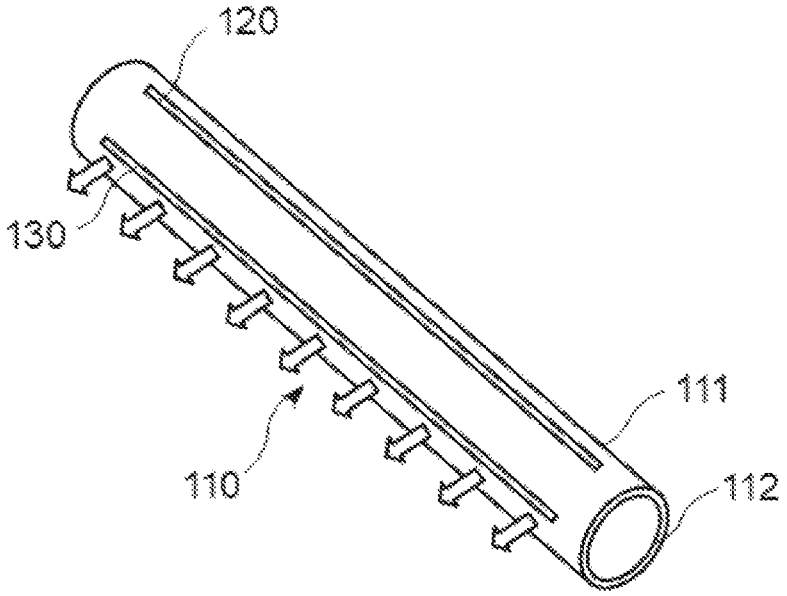
FIG. 8B is a schematic perspective view of the blower member of the second fixing apparatus illustrated in FIG. 8A.

In FIGS. 8A and 8B, the blower member 110 is set to the pattern 4. As mentioned above, the second fixing apparatus 100 may be configured to have both the usual fixing function and the gloss-imparting function. A preset temperature of the heater roller 101 when performing the usual fixing function is higher than a preset temperature of the heater roller 101 when performing the gloss-imparting function. For example, a preset temperature of the heater roller 101 when performing the usual fixing function is about 150° C. to 200° C. and a preset temperature of the heater roller 101 when performing the gloss-imparting function is about 120° C. to 160° C. Therefore, at the time of switching operation of the second fixing apparatus 100 from the usual fixing function to the gloss-imparting function, a stop time of the image forming apparatus 1 can be reduced by cooling the heater roller 101. Then, the blower member 110 may be set to the pattern 4 in order to cool the entire heater roller 101. The blower member 110 set to the pattern 4 blows airflow to the full width of the heater roller 101 using the second opening 130 selectively, to cool the heater roller 101.

Figure 4C:
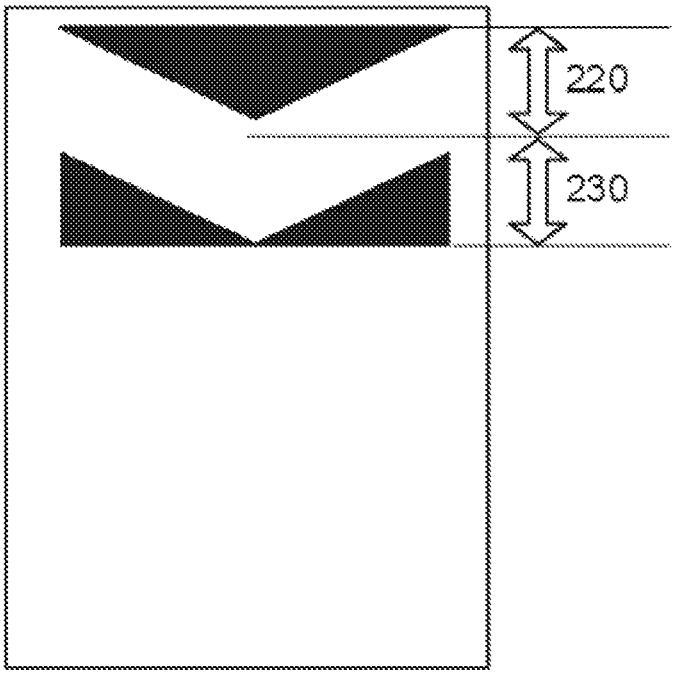
FIG. 4C is a planar-development view of another example second sleeve including a distribution mechanism formed in the second sleeve.

FIG. 4C shows a developed view of the second sleeve 112 showing a gradually varying opening pattern of a first distribution opening 220 and a second distribution opening 230 formed in the second sleeve 112 according to another example of the present disclosure. This gradually varying opening pattern can be regarded as continuously changing (or gradually varying) the size of the openings from $A_1$ to $A_4$ and from $B_1$ to $B_4$, respectively, (and vice versa) mentioned above. For example, this gradually varying opening pattern may be used for a printing medium P of an irregular paper size. A rotation of the second sleeve 112 allows the first distribution opening 220 and the second distribution opening 230 formed in the second sleeve 112 to be aligned respectively with the first opening 120 and the second opening 130 of the first sleeve 111, so that airflow is blown from the first opening 120 and the second opening 130. The first distribution opening 220 of the second sleeve 112 may be configured to cause a continuous change in an opening rate of the first opening 120 of the first sleeve 111 from 0% to 100% as the second sleeve 112 rotates, and the second distribution opening 230 may be configured to cause, concomitantly, a continuous change in an opening rate of the second opening 130 from 100% to 0%. In this case, the sum of an opening rate of the first opening 120 and an opening rate of the second opening 130 can be 100%. For example, the first distribution opening 220 can be configured to cause a continuous decrease in an area of opening of the first opening 120 from the ends toward the center as the second sleeve rotates, and the second distribution opening 230 can be configured to cause, concomitantly, a continuous increase in an area of opening of the second opening 130 from the ends toward the center. For example, the shape of the first distribution opening 220 is an approximate triangle and the shape of the second distribution opening 230 is a concave shape complementary to the approximate triangle. As one example, as shown in FIG. 4C, the shape of the first distribution opening 220 can be an isosceles triangle having its base in the axial direction of the second sleeve 112, and the shape of the second distribution opening 230 can be a concave pentagon having a longer side in the axial direction of the second sleeve 112 and having two sides perpendicular to the longer side. In this case, the concave angle of the concave pentagon of the second distribution opening 230 corresponds to the vertex angle of the isosceles triangle of the first distribution opening 220.

The second fixing apparatus 100 can be provided with a shield plate 140 so that airflow from the first opening 120 can be blown more reliably toward the endless belt 104 and airflow from the second opening 130 can be blown more reliably toward the heater roller 101. For example, the shield plate 140 may be disposed between the first opening 120 and the second opening 130 of the blower member 110 as shown in FIGS. 5A to 8A. The shield plate 140 further enhances the efficiency of cooling the endless belt 104 and the heater roller 101.

The aforementioned descriptions have been presented in order to illustrate and describe examples of the principles explained. The present description is not intended to be exhaustive or to limit these principles to one completely the same as any form disclosed. Many variations and modifications are possible in view of the aforementioned teachings.

The invention claimed is:

1. A fixing apparatus comprising:

a heater roper;

a tension roller;

a belt movable from the heater roller to the tension roller;

a pressure roller to make pressure contact with the heater roller via the belt to form a fixing nip; and a blower member including a first opening to direct air toward the belt and a second opening to direct air toward the heater roller.

2. The fixing apparatus according to claim 1, wherein the first and second openings are elongated openings extending in the width direction of the belt and having a length substantially the same as the width of the belt.

3. The fixing apparatus according to claim 2, comprising an arrangement of openings to selectively vary a pattern of airflow directed through the first opening and the second opening.

4. The fixing apparatus according to claim 3, the arrangement of openings to vary the pattern of airflow according to a width of a printing medium.

5. The fixing apparatus according to claim 3, wherein the blower member comprises a first sleeve formed with the first and second openings and a second sleeve disposed telescopically and rotatably with respect to the first sleeve, wherein the second sleeve includes the arrangement of openings.

6. The fixing apparatus according to claim 5, wherein the arrangement of openings includes a pattern of distribution openings to direct air through the full length of the first opening and to block the second opening.

7. The fixing apparatus according to claim 5, wherein the arrangement of openings includes a pattern of distribution openings to direct air through a center portion of the first opening and to direct air through ends of the second opening.

8. The fixing apparatus according to claim 5, wherein the arrangement of openings includes a pattern of distribution openings to direct air through the full length of the second opening and to block the first opening.

9. The fixing apparatus according to claim 5, wherein the arrangement of openings includes:

a first pattern of distribution openings to direct air through the full length of the first opening and to block the second opening;

a second pattern of distribution openings to direct air through a center portion of the first opening and to direct air through ends of the second opening; and a third pattern of distribution openings to direct air through the full length of the second opening and to block the first opening, wherein the sum of areas of the distribution openings in the first pattern of distribution openings, the sum of areas of the distribution openings in the second pattern of distribution openings and the sum of areas of the distribution openings in the third pattern of distribution openings are equal.

10. The fixing apparatus according to claim 5, wherein the second sleeve is rotatable to cause a gradual change in an opening rate of the first opening from 0% to 100%, and to simultaneous cause a gradual change in an opening rate of the second opening inversely from 100% to 0% when the second sleeve rotates.

11. The fixing apparatus according to claim 10, wherein the arrangement of openings includes a first distribution opening and a second distribution opening to simultaneously cause, when the second sleeve rotates, a continuous decrease in a first area where the first distribution opening overlaps the first opening, from ends of the first opening toward a center of the first opening, and a continuous increase in a second area where the second distribution opening overlaps the second opening, from the ends toward the center.

12. The fixing apparatus according to claim 11, wherein the first distribution opening has a substantially triangular shape and the second distribution opening has a shape that is substantially complementary to the substantially triangular shape of the first distribution opening.

13. The fixing apparatus according to claim 5, wherein the second sleeve is disposed inside the first sleeve and the first sleeve is provided with a shield plate disposed between the first opening and the second opening.

14. An image forming apparatus comprising:

a fixing apparatus including:

a heater roller to rotate;

a tension roller to rotate;

a belt that is rotatable to convey a print medium from the heater roller to the tension roller;

a pressure roller to make pressure contact with the heater roller via the belt to form a fixing nip; and a blower member to generate an airflow, wherein the blower member includes a first opening to direct a first part of the airflow toward the belt and a second opening to direct a second part of the airflow toward the heater roller.

15. The image forming apparatus according to claim 14, comprising an arrangement of openings to selectively vary a pattern of airflow through the first opening and the second opening.

* * * * *